US007685909B1

(12) United States Patent
Jones

(10) Patent No.: US 7,685,909 B1
(45) Date of Patent: Mar. 30, 2010

(54) POWERED SHINGLE RIPPER

(76) Inventor: Ryan S. Jones, 14081 E. 800th Ave., Effingham, IL (US) 62401

( * ) Notice: Subject to any disclaimer, the term of this patent is extended or adjusted under 35 U.S.C. 154(b) by 47 days.

(21) Appl. No.: 12/130,195

(22) Filed: May 30, 2008

(51) Int. Cl.
*E04D 15/02* (2006.01)

(52) U.S. Cl. ..... 81/45

(58) Field of Classification Search ..... 81/45; 299/37.1

See application file for complete search history.

(56) References Cited

U.S. PATENT DOCUMENTS

| | | | | |
|---|---|---|---|---|
| 2,245,544 | A | 6/1941 | Miller | |
| 2,519,138 | A * | 8/1950 | Ketz | 299/37.1 |
| 4,277,104 | A | 7/1981 | Sanchez | |
| 4,709,479 | A | 12/1987 | Lavelette | |
| 4,880,491 | A | 11/1989 | Jacobs et al. | |
| 5,098,165 | A | 3/1992 | Jacobs et al. | |
| 5,218,766 | A | 6/1993 | Himebaugh | |
| 5,741,047 | A | 4/1998 | Ordonez | |
| 5,800,021 | A | 9/1998 | Derr | |
| 5,921,155 | A * | 7/1999 | Faller et al. | 81/45 |
| 5,988,021 | A * | 11/1999 | Nicolosi et al. | 81/45 |
| 6,095,015 | A | 8/2000 | Phelan | |
| 6,116,117 | A | 9/2000 | Nicolosi et al. | |
| 6,393,948 | B1 * | 5/2002 | Hutchins | 81/45 |
| 6,711,971 | B1 | 3/2004 | Morin | |
| 7,127,968 | B1 | 10/2006 | Kriegar | |
| 2007/0000354 | A1 | 1/2007 | Tyler | |

* cited by examiner

*Primary Examiner*—David B Thomas
(74) *Attorney, Agent, or Firm*—Grace J. Fishel

(57) ABSTRACT

A powered shingle ripper with a rocker assembly having a serrated blade. The rocker assemble is eccentrically mounted for rotation about an axis in a manner that the leading edge of the serrated blade reciprocates back and forth and up and down. Rotation of the rocker assembly about the axis is confined to a predetermined arc, the orientation of which may be under operator control.

10 Claims, 5 Drawing Sheets

POWERED SHINGLE RIPPER

BACKGROUND OF THE INVENTION

1. Field of the Invention

The present invention relates to a shingle ripper which is pushed across a sloping shingled roof and which uses a powered bladed rocker assembly to lift and remove overlapping ranks of previously installed fastener connected shingles.

2. Brief Description of the Prior Art

While it is common practice to install a second layer of new shingles over a single existing layer, eventually the older shingles must be removed. Shingles are taken off in the reverse order in which they were put on. Starting at the peak, ridge shingles are removed first. Once the ridge shingles are off, a specially designed tear-off shovel with a serrated edge and a fulcrum welded to the back of the shovel head is used to get behind and above the shingles. The tip of the shovel is slid down until stopped by the nails which are caught in the serrated edge. The handle is levered down to raise the front of the shovel up. Ideally the nails pop out and the shingle, which is then freed, slides down the sloped roof. Any protruding nails which are left behind should be removed or hammered down.

Tearing off roof shingles is labor intensive and a major cost factor in reroofing. Various powered machines have been proposed in the past (e.g., U.S. patents listed on an Information Disclosure Statement submitted herewith) but, insofar of known, none are in common commercial use. Perhaps this is because conditions on roofs vary from job to job as to the number of layers of shingles to be removed, the composition and condition of the shingles, the composition and condition of the underlayment of felt or tarpaper and the condition of the sheathing. Hence for practical use, it would desirable for the operator of a powered machine to be able to adjust the machine to varying conditions as can a worker with a hand operated tear-off shovel.

BRIEF SUMMARY OF THE INVENTION

In view of the above, it is an object of the present invention to provide a powered shingle ripper. It is a further object to provide a ripper which may be adjusted to roof conditions. Other objects and features of the invention will be in part apparent and in part pointed out hereinafter.

In accordance with the invention, a powered shingle ripper in major part includes a frame with a handle connected to the frame for pushing the shingle ripper. A power source and a rocker assembly are mounted on the frame. The rocker assembly includes a support member extending laterally across the frame with a serrated blade mounted thereon. The support member is rotatably mounted in bearings on an axle having right and left ends. The ends of the axle are connected to right and left driven members which are journaled about an axis in the frame. One of the driven members is connected by a power train to the power source for rotation of the axle about the axis of the driven members. A piston is connected to the support member. The piston is reciprocated in a cylinder block pivotally mounted on the frame such that the piston confines the support member to a specific arc of rotation on the axle. Shims are preferably provided between a pivoted end of the cylinder block and the frame such the angle of the blade with respect to a roof may be adjusted to stripping conditions.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
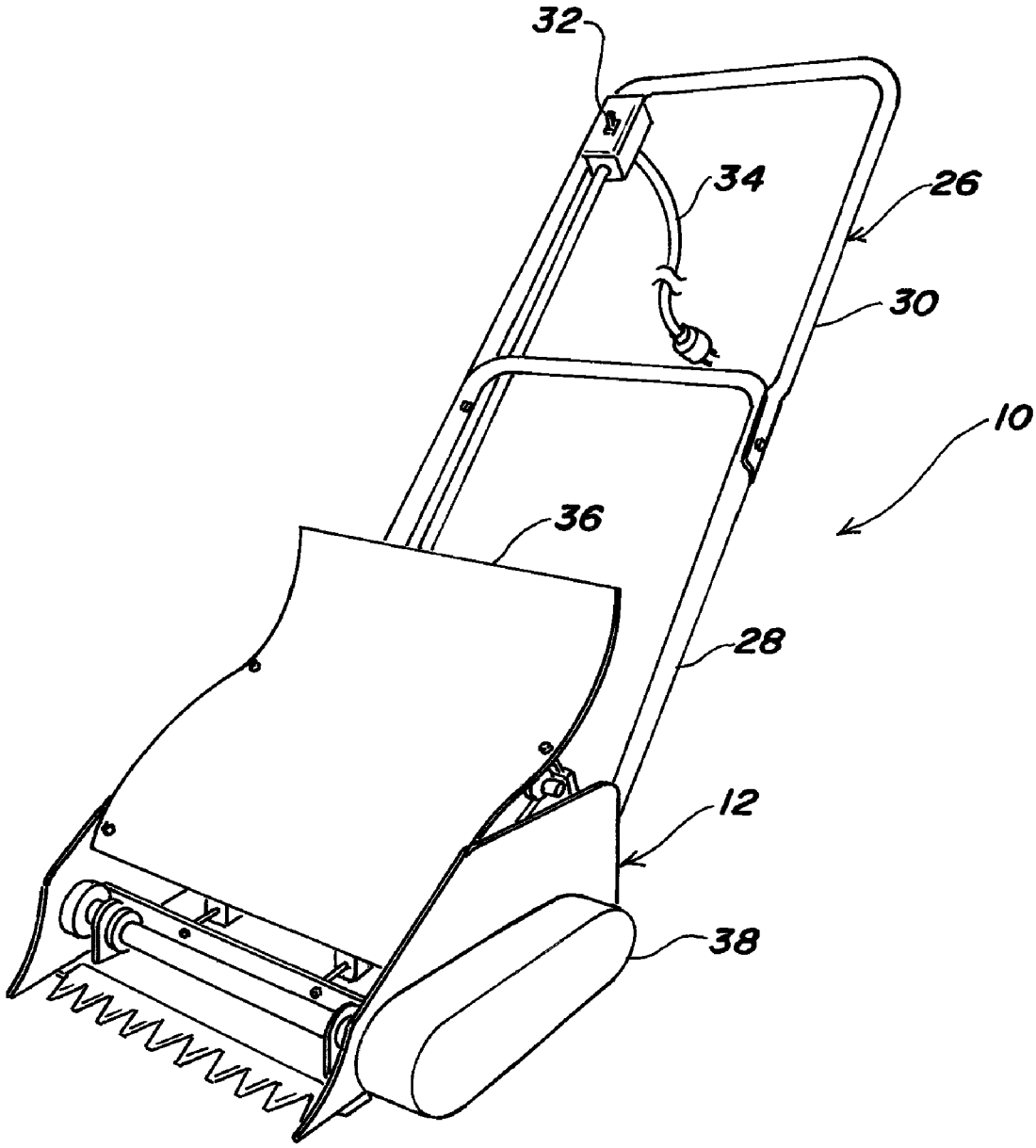
FIG. 1 is a side elevation of a shingle ripper in accordance with the present invention.
Figure 2:
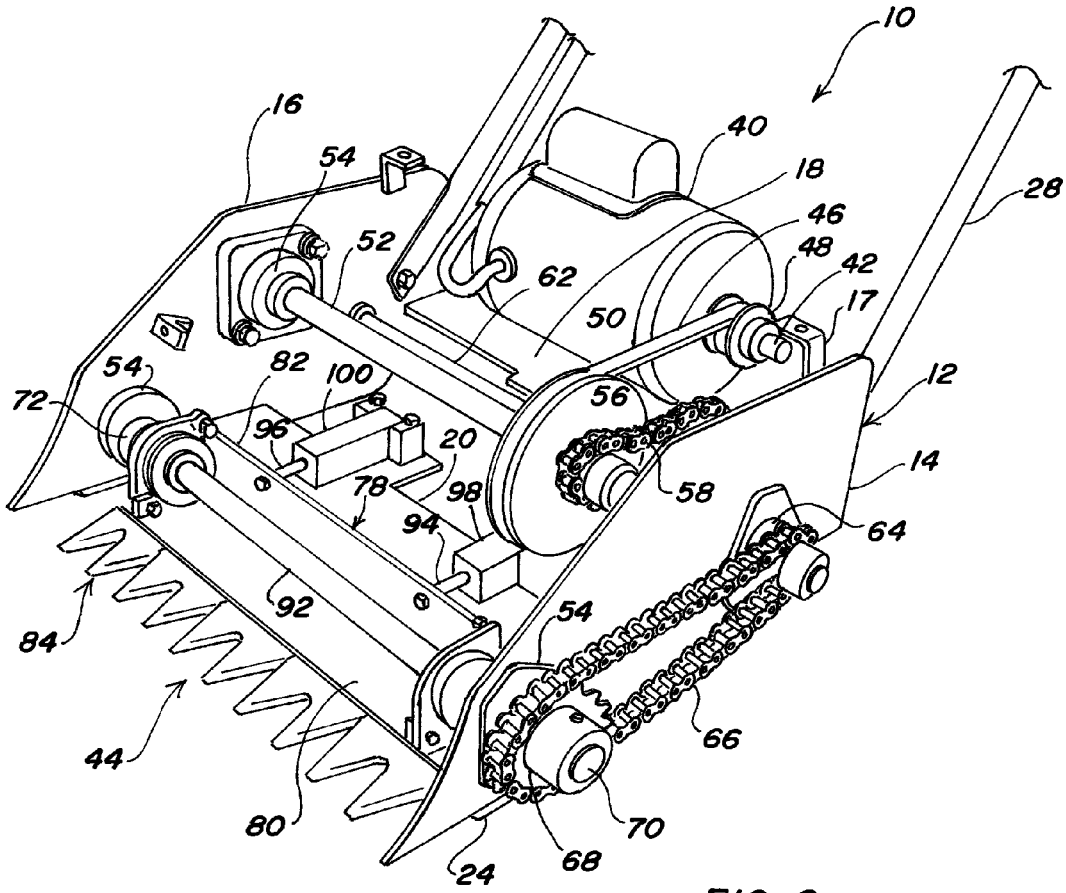
FIG. 2 is a fragmentary side elevation of the ripper with a deflector cover and a side guard removed.
Figure 3:
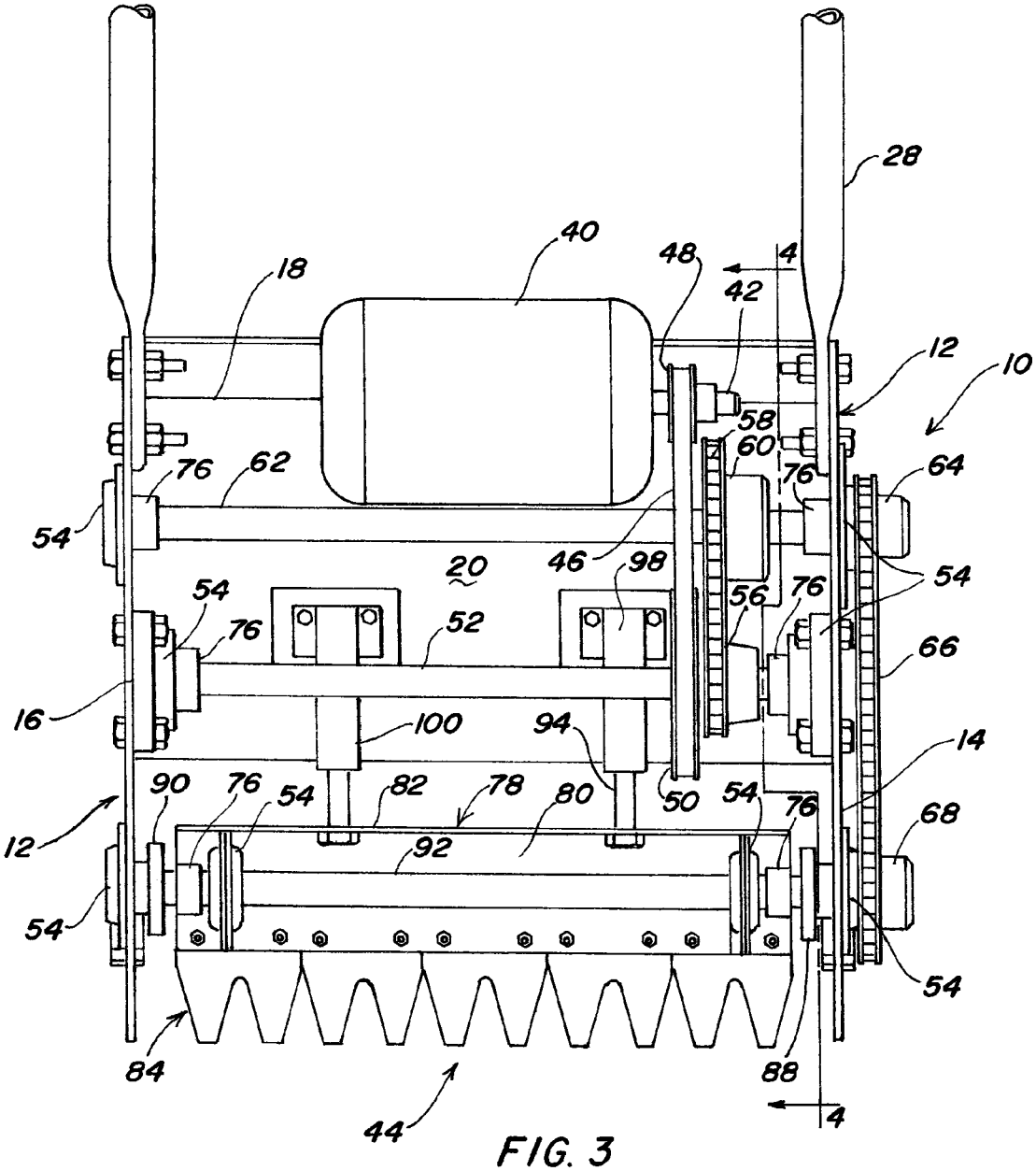
FIG. 3 is a plan view of the ripper as shown in FIG. 2.

Referring to the drawings more particularly by reference character, a powered shingle ripper 10 in accordance with the present invention is shown in FIGS. 1-3. Ripper 10 includes a frame 12 composed of left and right sidewalls 14, 16, respectively, a back wall 17 and first and second cross-members 18, 20 extending transversely of and connecting sidewalls 14, 16 together. A pair of wheels 22 (FIG. 4A) extend from sidewalls 14, 16 generally adjacent the rearward portion thereof and support the back end of ripper 10. A pair of skids 24 (FIG. 2) are provided on sidewalls 14, 16 at the forward portion thereof and support the front end of ripper 10.

A handlebar assembly 26 extends from the rearward end of frame 12, enabling an operator to control and maneuver the machine on wheels 22 and skids 24. As seen in FIGS. 2 and 3, a lower U-shaped handle section 28 of handlebar assembly 26 is bolted or otherwise attached to sidewalls 14, 16 and as seen in FIG. 1, an upper U-shaped handle section 30 is bolted or otherwise attached along the bight of lower U-shaped handle section 28. When this connection is loosened, upper U-shaped handle section 30 may be folded against lower U-shaped handle section 28 for storage or transport of ripper 10. When ripper 10 is electrically powered, a switch 32 may be provided on handlebar assembly 26 for actuating the motor with electric current provided through a power cord 34. A deflector cover 36 as shown in FIG. 1 may be installed at the forward portion of ripper 10 in order to keep loosened shingles from falling into frame 12 as more particularly described below. A side guard 38 may also be provided for safety.

A power source 40 is mounted on frame 12. Power source 40 may be an electric motor with a drive shaft 42 or a gasoline powered engine. As shown in the drawings, electric motor 40 is mounted on cross member 18 and is connected by a power train to a rocker assembly 44.

In the form illustrated, power train begins at drive shaft 42 of motor 40. A belt 46 couples a pulley 48 on drive shaft 42 to a pulley 50 mounted on a shaft 52 that extends transversely of sidewalls 14, 16 and is rotatably journaled at opposite ends thereof in bearings 54. A first drive sprocket 56 is mounted on and rotates with shaft 52. A first chain drive 58 couples first drive sprocket 56 with a first driven sprocket 60 mounted on a jack shaft 62. Jack shaft 62 is rotatably journaled in bearings 54 and extends transversely of sidewalls 14, 16 with a left end extending through bearing 54. A second drive sprocket 64 is mounted on and rotates with jack shaft 62. A second chain drive 66 couples second drive sprocket 64 to a second driven sprocket 68 which is mounted on a first stub shaft 70 rotatably mounted in a bearing 54 on the left hand side of frame 12. A second stub shaft 72 is rotatably mounted in a similar bearing 54 on the right hand side of frame 12. First and second stub shafts 70, 72 are aligned for rotation about a common axis 74 (FIGS. 4A-4D). Locking rings 76 fix shaft 52 and jack shaft 62 in bearings 54. Other locking rings 76 fix stub shafts 70, 72 in bearings 54.

The purpose of the drive train just described is to slow down the rotation and increase the torque applied by motor 40 to first stub shaft 70. For example, with a ¼" pulley 48, 5" pulley 50, a 12 to 32 tooth reduction between first drive sprocket 56 and first driven sprocket 60 and a 12 to 16 tooth reduction between second drive sprocket 64 and second driven sprocket 68, motor 40 with an output speed of 3450 rpm may reduced at first stub shaft 70 to about 100 to 400 rpm with a corresponding increase in torque. It will be understood that the foregoing details are illustrative and not limiting. Belts, drive chains, pulleys and sprockets are interchangeable elements and other arrangements of the elements and different sizes may be used in other drive trains. In still yet other drive trains drive shaft 42 may coupled to stub shaft 70 through a gearbox or a rheostat may be used to control the speed of drive shaft 42 such that drive shaft 42 may be directly coupled to first stub shaft 70. Other such variations are possible as will occur to one skilled in the art.

Figure 5:
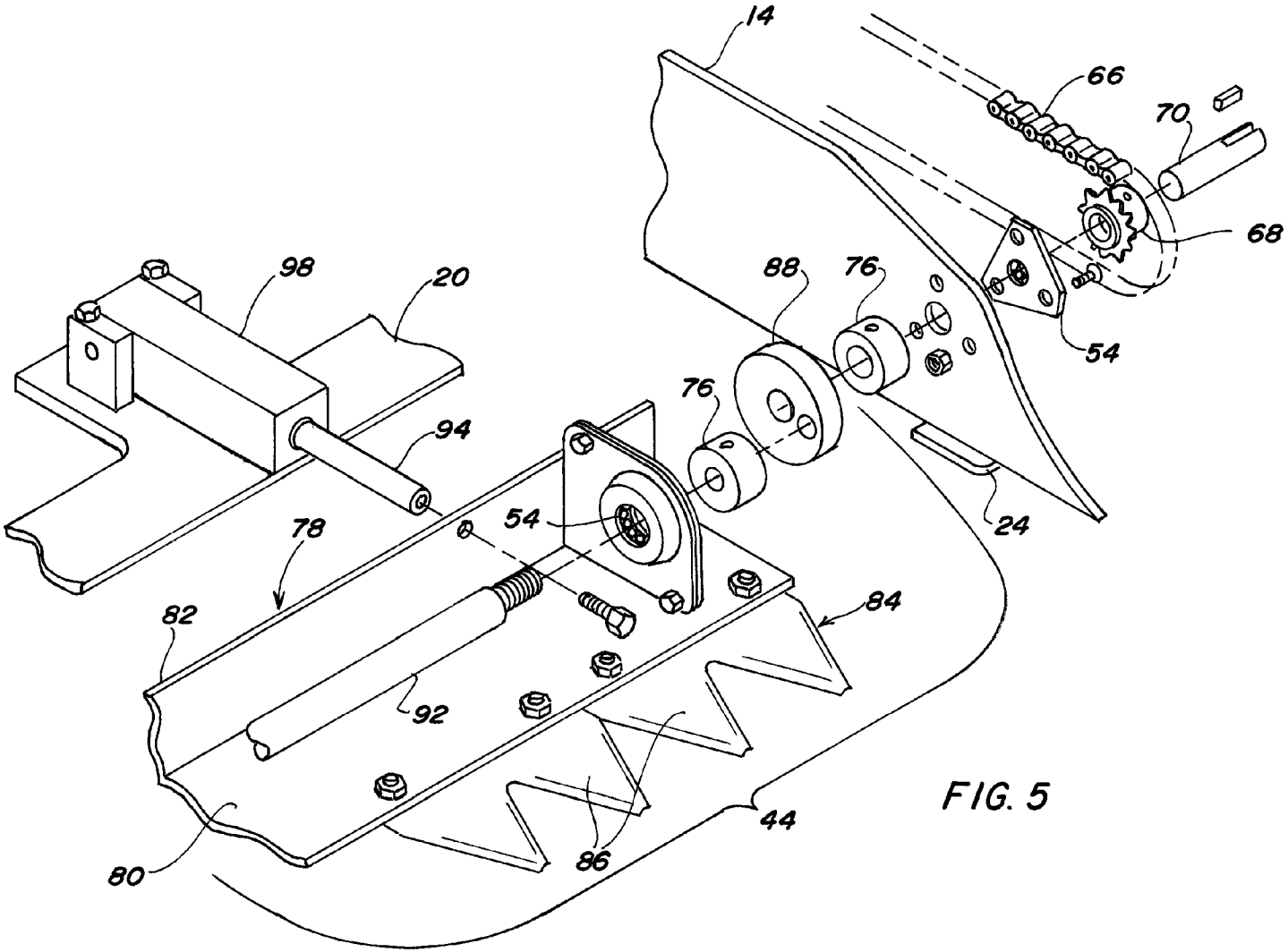

As best seen in FIG. 5, rocker assembly 44 includes a support member 78 extending laterally across frame 12. As illustrated, support member 78 extends essentially the entire width of frame 12 and is L-shaped with a horizontal, forwardly extending, leg 80 and a vertical leg 82. A serrated blade 84 is mounted on horizontal leg 80 with conventional threaded fasteners or other suitable attachment means. As shown serrated blade 84 may be made up of a plurality of commercially available sickle blades 86 to facilitate replacement when required.

Left and right members 88, 90 are threaded for attachment to first and second stub shafts 70, 72, respectively, for rotation about common axis 74. In the form illustrated, power from drive train is applied to left member 88 but power could be applied to right member 90 by rearrangement of the drive train.

Support member 78 is rotatably mounted on an axle 92. For which purpose, as illustrated, bearings 54 are provided. First and second threaded ends of axle 92 extend through bearings 54 and are eccentrically connected to left and right members 88, 90 for rotation of axle 92 about common axis 74 of stub shafts 70, 72 as shown in FIGS. 4A-4D. Locking rings 76 are provided on axle 92 outboard of bearings 54 such that support member 78 cannot shift left to right on axle 92. In the form illustrated, left member 88 connects rocker assembly 44 to the drive train at first stub shaft 70.

With continuing reference to FIG. 5, a pair of spaced apart, left and right pistons 94, 96, respectively, are connected to vertical leg 82 of support member 78. Pistons 94,96 are reciprocated in left and right cylinder blocks 98, 100 which are mounted on cross-member 20 of frame 12. As shown in FIGS. 4A-4D, pistons 94, 96 confine support member 44 to a specific arc of rotation about common axis 74. One or more shims 102 may be provided between a pivoted end of cylinder blocks 98, 100 and cross-member 20 to adjust the angle that serrated blade 84 makes with respect to a roof for use as more particularly described below.

Figure 4A:
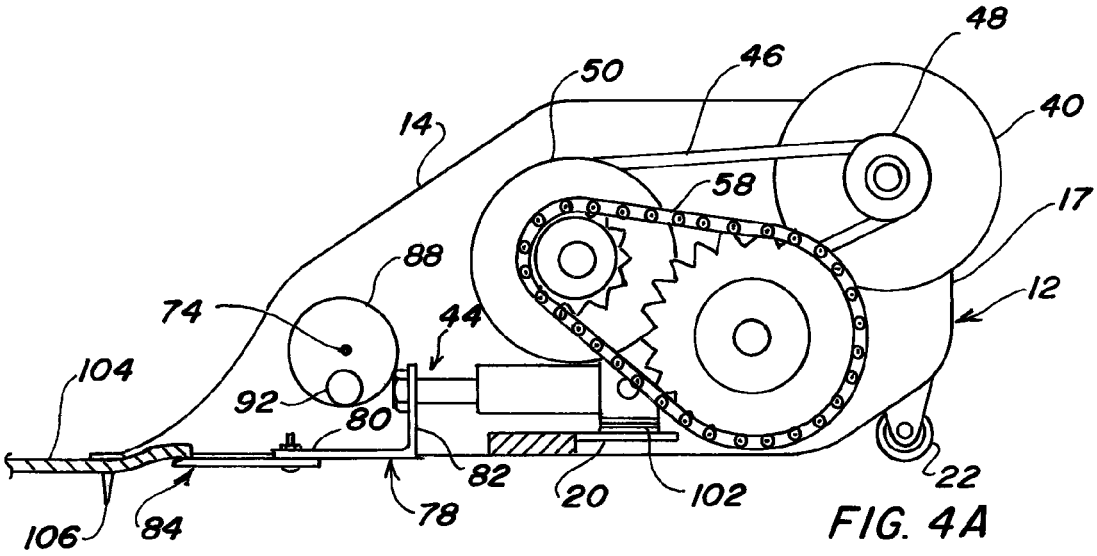
FIGS. 4A, 4B, 4C and 4D are a sequential series of left side elevational views showing the position of a bladed rocker assembly during the rotation of the rocker assembly; and, FIG. 5 is an exploded enlarged perspective view of the rocker assembly.
Figure 4B:
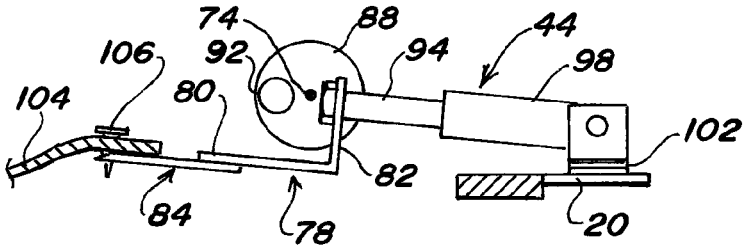
Figure 4C:
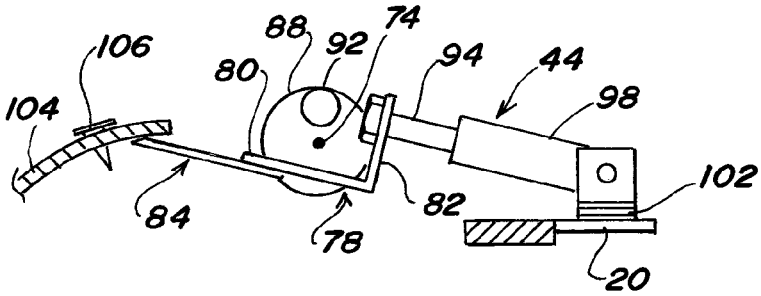
Figure 4D:
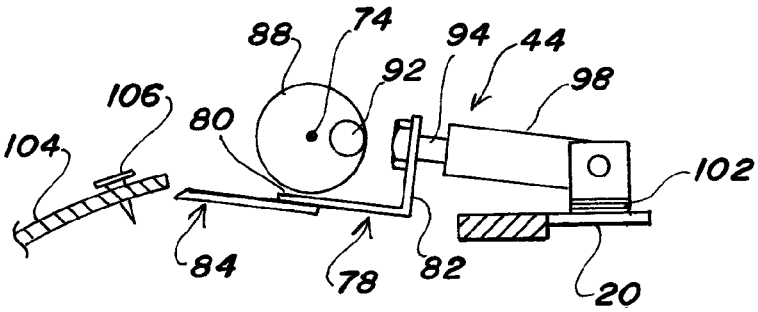

In use, ripper 10 is guided by an operator over different areas of a sloped roof, in successive paths parallel to the roof peak, while removing horizontal ranks of roofing materials via serrated blade 84 which is rotated in a clockwise circular manner as viewed in FIGS. 4A-4D by member 88. For this purpose, the operator, by use of handlebar assembly 26, advances ripper 10 on wheels 22 and skids 24 such that a leading edge of serrated blade 84 is beneath the roofing material to be removed (FIG. 4A). As the leading edge contacts the underside of a shingle 104, the shingle and any fastener 106 such as staples or nails are lifted upwardly (FIG. 4B). After the leading edge has lifted shingle 104 from the surface, serrated blade 84 continues in a rearward motion (FIG. 4C) freeing the debris to slide down the sloped roof (FIG. 4D). The operator then advances ripper* for removal of the next shingle in the rank and so forth through the ranks until all the shingles have been removed.

Depending on the number of layers of shingles to be removed and the condition of the underlayment and sheathing, it may be advantageous for the leading edge of serrated blade 84 to be angled such that the serrated blade stabs downwardly as well as forwardly at the interface between the sheathing and shingle 102. As shown in FIG. 4A, serrated blade 84 is substantially parallel with sheathing. However if shims 102 are added under the pivoted end of left and right piston blocks 98, 100, the leading edge may be angled downwardly. On the other hand, if the operator finds the action of ripper 10 too aggressive for conditions, shims 102 may be removed such that serrated blade 84 slopes upwardly. Thus by providing the option of adding or subtracting shims 102 the operator may adjust ripper 10 to the particular stripping conditions on a job.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A powered shingle ripper comprising a frame having a front and rear end;

a handle connected to the frame at the rear for pushing the shingle ripper;

a power source mounted on the frame, a power train, a rocker assembly mounted in the frame, said rocker assembly comprising a support member extending laterally across the frame, said support member having a serrated blade mounted thereon and said support member rotatably mounted in bearings on an axle at the front of the frame, said axle having right and left ends, said right and left ends eccentrically connected to right and left driven members, said right and left driven members journaled about an axis in the frame, said driven members connected by the power train to the power source for rotation of the axle about the axis of the driven members, at least one piston independent of the driven members connected to the support member, said piston reciprocated in a cylinder block pivotally mounted on the frame, said piston confining the support member to a specific arc of rotation on the axle.

2. The powered shingle ripper of claim 1 wherein one or more shims is provided between a pivoted end of the cylinder block and the frame.

3. A powered shingle ripper comprising a frame;

a handle connected to the frame for pushing the shingle ripper;

an electric motor mounted on the frame, a power train, a rocker assembly mounted in the frame, said rocker assembly comprising an L-shaped support member having a horizontal leg and a vertical leg, said L-shaped support member extending laterally across the frame, said support member having a serrated blade mounted on the horizontal leg and said L-shaped support member rotatably mounted in bearings on an axle, said bearings mounted on the L-shaped support member, said axle having right and left ends, said right and left ends eccentrically connected to right and left driven members, said right and left driven members journaled about an axis in the frame, one of said driven members connected by the power train to the electric motor for rotation of the axle about the axis of the driven members, at least one piston connected to the vertical leg of the L-shaped support member, said piston reciprocated in a cylinder block pivotally mounted on the frame, said piston confining the L-shaped support member to a specific arc of rotation on the axle.

4. The powered shingle ripper of claim 3 wherein one or more shims is provided between a pivoted end of the cylinder block and the frame.

5. The powered shingle ripper of claim 3 wherein the power train includes means for slowing down and increasing the torque applied by the electric motor to the driven members.

6. The powered shingle ripper of claim 5 wherein the drive train includes a pulley mounted on an output shaft of the electric motor coupled with a drive belt to a larger pulley mounted on a shaft journaled in the frame, a first drive sprocket mounted on the shaft coupled with a first drive chain to a larger first driven sprocket mounted on a jack shaft journaled in the frame, a second drive sprocket mounted on the jack shaft coupled with a second drive chain to a larger second driven sprocket mounted on a first stub shaft journaled in the frame.

7. The powered shingle ripper of claim 6 wherein a first of the driven members is mounted on the first stub shaft and a second of the driven members is mounted on a second stub shaft, said first and second stub shafts being aligned for rotation about a common axis.

8. The powered shingle ripper of claim 7 wherein the shaft, the jack shaft and the first and second stub shafts are journaled in bearings.

9. The powered shingle ripper of claim 8 wherein locking rings are provided on the shaft, the jack shaft and the first and second stub shafts for securing said shafts in the bearings.

10. The powered shingle ripper of claim 3 wherein locking rings are provided on the axle for locking the axle in the bearings.

* * * * *